US006082227A

United States Patent [19]

Vogel

[11] Patent Number: 6,082,227

[45] Date of Patent: Jul. 4, 2000

[54] VISUAL CODING SYSTEM FOR TOOL SIZE

[76] Inventor: Arthur C. Vogel, 150 Lake Dr., Mountain Lakes, N.J. 07046

[21] Appl. No.: 08/977,063

[22] Filed: Nov. 24, 1997

Related U.S. Application Data

[60] Provisional application No. 60/032,747, Dec. 17, 1996.

[51] Int. Cl.[7] ..... B25B 13/02

[52] U.S. Cl. ..... 81/119; 81/DIG. 5

[58] Field of Search ..... 81/DIG. 5, 180.1, 81/119; 116/335, 334, 200, 201, 280; 206/376

[56] References Cited

U.S. PATENT DOCUMENTS

| | | | |
|---|---|---|---|
| 4,800,786 | 1/1989 | Arnold et al. | 81/DIG. 5 |
| 4,936,170 | 6/1990 | Zumeta | 81/DIG. 5 |
| 4,947,713 | 8/1990 | Arnold | 81/DIG. 5 |
| 4,982,627 | 1/1991 | Johnson | 81/DIG. 5 |
| 5,031,488 | 7/1991 | Zumeta | 81/DIG. 5 |
| 5,079,978 | 1/1992 | Kupfer | 81/DIG. 5 |
| 5,181,439 | 1/1993 | Schwartz | 81/DIG. 5 |

*Primary Examiner*—David A. Scherbel
*Assistant Examiner*—Joni B. Danganan

[57] ABSTRACT

A novel system for visually coding tools as to their size comprises a maximum of two sets of differently colored bands which are placed on the surface of the tool. Each band of each color represents a portion of the size of the tool. Thus, when the number of bands of each color is counted, the size of the tool is indicated. Different colors are used to indicate metric tools versus English tools. Different color schemes may be used to represent the ownership of the tools.

18 Claims, 3 Drawing Sheets

VISUAL CODING SYSTEM FOR TOOL SIZE

This Appln claims the benefit of U.S. Provisional Appln Ser. No. 60/032,747 filed Dec. 17, 1996.

FIELD OF THE INVENTION

The present invention relates generally to the field of identification systems for tools. More particularly, the present invention relates to the field of visual coding systems for identifying the size of tool to a user.

BACKGROUND OF THE INVENTION

In the field of automotive repair, a wide variety of differently sized tools, particularly socket and handled wrenches, are required. The size of such wrenches is most often measured according to the metric system in millimeters, or according to the English system in fractions of inches.

The size difference between a metric wrench and an English wrench may be so small that it becomes virtually impossible to visually distinguish the wrenches based on size alone. This presents a problem when a repair or maintenance job requires wrenches measured by both of the two systems.

Accordingly, handled wrenches have the size of the wrench measured in either English or metric units stamped into the wrench. Sockets in a socket wrench set may have the socket size stamped into the outer surface of the socket or listed on some type of case for holding the individual sockets.

These methods of identifying the size of a tool are inadequate. Automotive repair is frequently performed under poor lighting conditions. Moreover, automotive repair is generally performed in an environment in which grease, oil, dust, dirt, etc. can easily soil the surface of a tool and obscure the size information which is stamped thereon.

These factors can make it extremely frustrating to identify the size of a tool so that the proper tool is obtained. Accordingly, there is a need for a more efficient system of visually coding tools as to their size which is easily seen even in poor lighting or through soil on the tool.

SUMMARY OF THE INVENTION

Accordingly, it is an object of the present invention to provide a system for marking tools according to their size using a visual code which is easily seen even in poor lighting or with soil on the tool.

Additional objects, advantages and novel features of the invention will be set forth in the description which follows or may be learned by those skilled in the art through reading these materials or practicing the invention. The objects and advantages of the invention may be achieved through the means recited in the attached claims.

To achieve the stated and other objects of the present invention, as embodied and described below, the invention may comprise:

A tool of a particular size having at least one brightly colored marking thereon, wherein the number of markings and colors of the markings together indicate the precise size of the tool on which the markings are disposed. The markings may be bands or dots and may be recessed in the surface of the tool.

BRIEF DESCRIPTION OF THE DRAWINGS

The accompanying drawings illustrate the present invention and are a part of the specification. Together with the following description, the drawings demonstrate and explain the principles of the present invention. In the drawings.

DETAILED DESCRIPTION OF THE PREFERRED EMBODIMENT

Using the drawings, the preferred embodiment of the present invention will now be explained.

Figure 1:
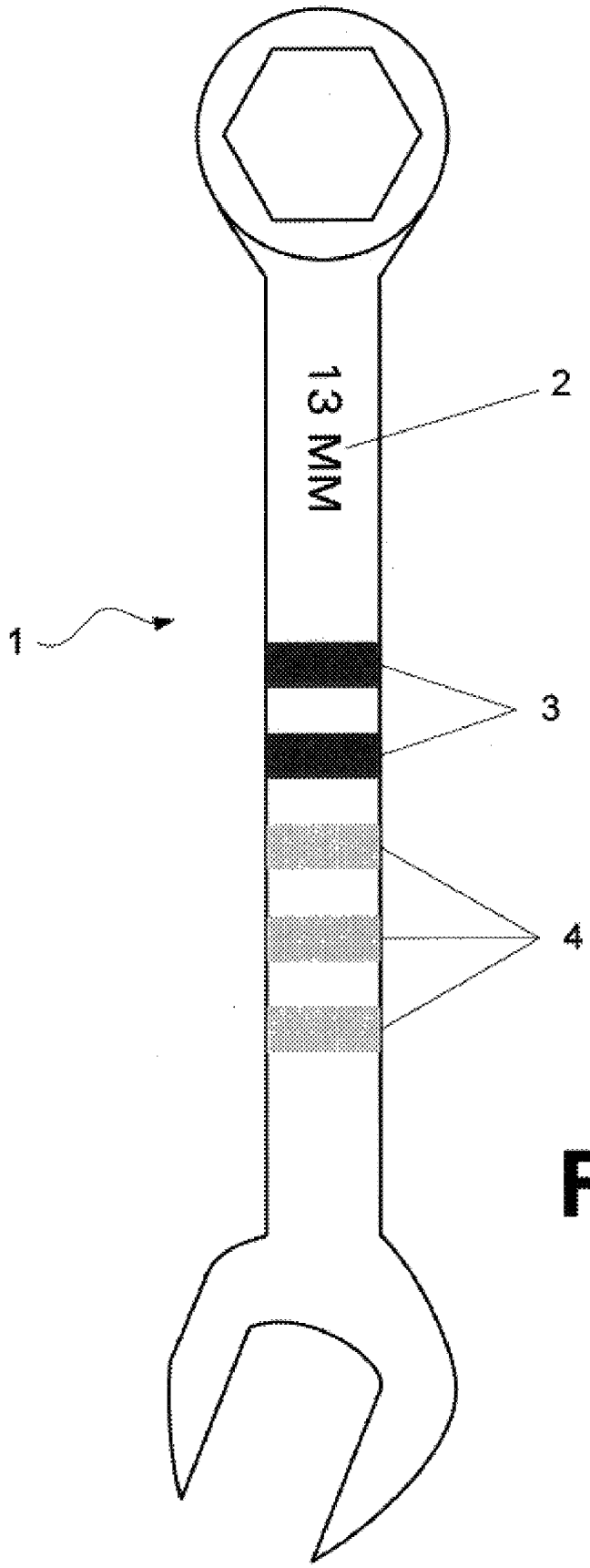
FIG. 1 illustrates a handled wrench the size of which is visually indicated by an embodiment of the coding system of the present invention.

By way of example, FIG. 1 shows a handled wrench 1 which has been marked according to the principles of the present invention. As is traditional, the size of the wrench 1, which is 13 mm, has been stamped 2 into the surface of the wrench. However, the size of the wrench is more clearly indicated by the sets of colored bands 3 and 4 according to the present invention.

The present invention uses at most two sets of differently colored bands. The colors are preferably bright and easily distinguishable, but may be chosen according to the preferences of the tool owner or manufacturer. Each band, according to its color, represents a portion of the size of the tool so that when the total number of bands of each color are counted, the size of the tool is indicated to the user.

In the example of FIG. 1, bands of a first color 3, preferably red, indicate a size of 5 mm per band. Thus, because there are two red bands 3, the size of the wrench is indicated as at least 10 mm (2 bands×5 mm per band=10 mm). Bands of a second color 4, preferably yellow or gold, indicate a size of 1 mm per band. Thus, because there are three yellow bands 4, the size of the wrench is indicated as 13 mm ([2 red bands×5 mm per band]+[3 yellow bands×1 mm per band]=13 mm).

According to this example, on any marked wrench there will be a maximum of four yellow bands. Also, because it is relatively easy to distinguish between large and small tools, the number of red bands may be limited to three with the system repeating itself over every 20 mm of range in the size of the wrenches. For example, a 19 mm wrench would be marked with three red and four yellow bands. A 39 mm wrench would be identically marked, however, no difficulty should be presented in distinguishing between a 19 mm wrench and 39 mm wrench.

To distinguish between tools sized on the metric and English system, two sets of colors could be used. For example, metric tools would be marked by red and yellow bands as described above, while English tools would be marked by, for example, green and yellow bands.

In a set of English tools, a single green band would represent an increment of ¼ of an inch and a yellow band, an increment of 1/16 of an inch. There would then be a maximum of 3 yellow bands on any English tool because 4 yellow bands would indicate 4/16 of an inch or ¼ of an inch and would, therefore, be replaced by a single green band.

Again, because it is relatively easy to distinguish between large and small tools, the number of green bands may be limited to three with the system repeating itself over every 1 inch of range in the size of the wrenches. For example, a 15/16 inch wrench would be marked with three green and three yellow bands. A $1\frac{15}{16}$ inch wrench would be identically marked, however, no difficulty should be presented in distinguishing between a $\frac{15}{16}$ inch wrench and a $1\frac{15}{16}$ inch wrench.

In this embodiment, wrenches which are smaller than ¼ of an inch or 5 mm would have only yellow bands. Therefore, a dashed green or red band, respectively, would be added to such wrenches to indicate whether they were English or metric. As an alternative, two color schemes which do not share a common color such as red-yellow and green-blue could be adopted for metric and English tools respectively. In such an embodiment, smaller sized tools would have only yellow or blue bands which would indicate whether the tool was metric or English respectively.

Finally, in a set of English wrenches, a very precise set of wrenches may include wrenches with increments of $\frac{1}{32}$ of an inch. Under the principles of the present invention, an additional dashed or dotted band or a band of another color could be used to indicate the $\frac{1}{32}$ of a inch increment of the wrench size. Only one such band would ever be needed because $2\times\frac{1}{32}$ of an inch equals $\frac{1}{16}$ of an inch and would be indicated by a single band of the color for $\frac{1}{16}$ of an inch.

Those of skill in the art will recognize that while the example of handled wrenches has been provided, the present invention could be applied to any tool, a set of which ranges in size. For example, the present invention may be applied to sockets in a socket wrench set. Those skilled in the art will see many other obvious applications.

The width of the bands should be selected to be easily seen, but not larger than can be conveniently arranged on the selected tool. For smaller tools, bands having a width of 0.040 inches and spaced at 0.040 inch intervals are satisfactory. For larger tools, bands having a width of 0.125 inches spaced at 0.125 inch intervals allow very easy and quick determinations of the tool size, even at arm's length.

The bands maybe painted on the tool or provided as a tape to be added to existing tools. The tool may also be manufactured with recesses in which the bands are painted or the tape applied to protect the bands from wear.

Figure 2:
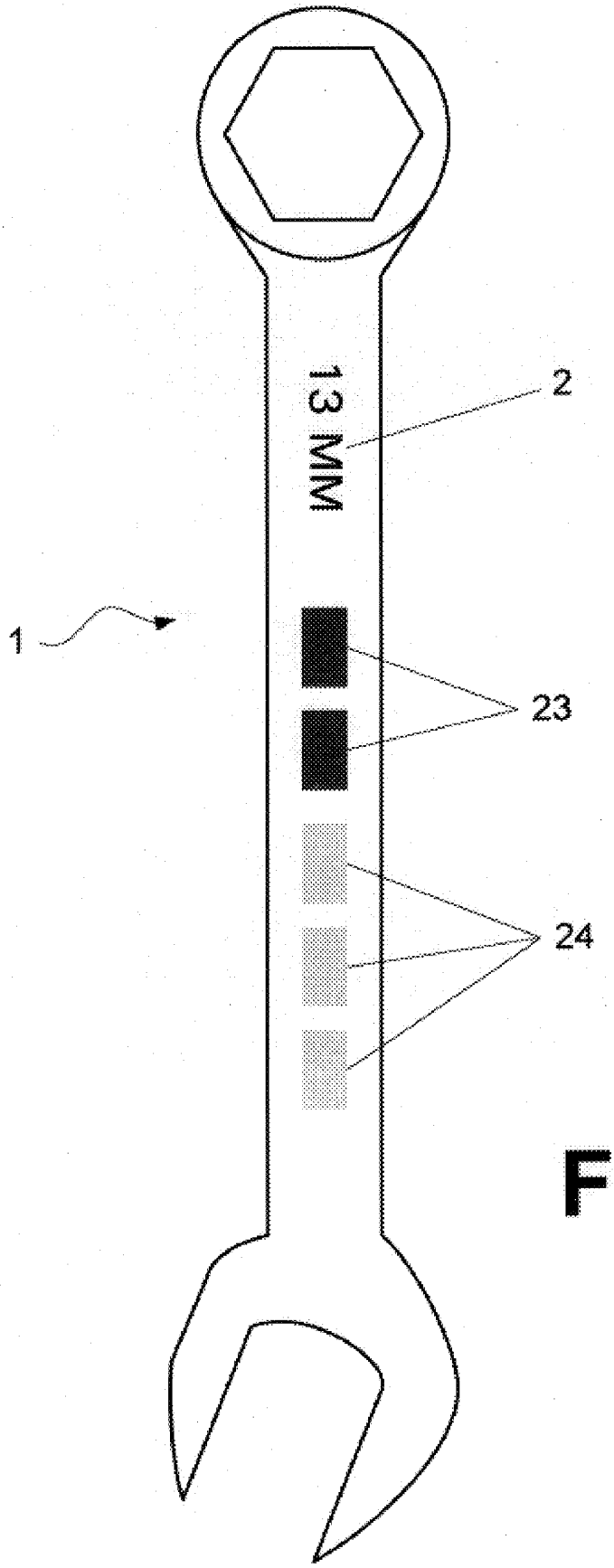
FIG. 2 illustrates a handled wrench the size of which is visually indicated by a second embodiment of the coding system of the present invention.
Figure 3:
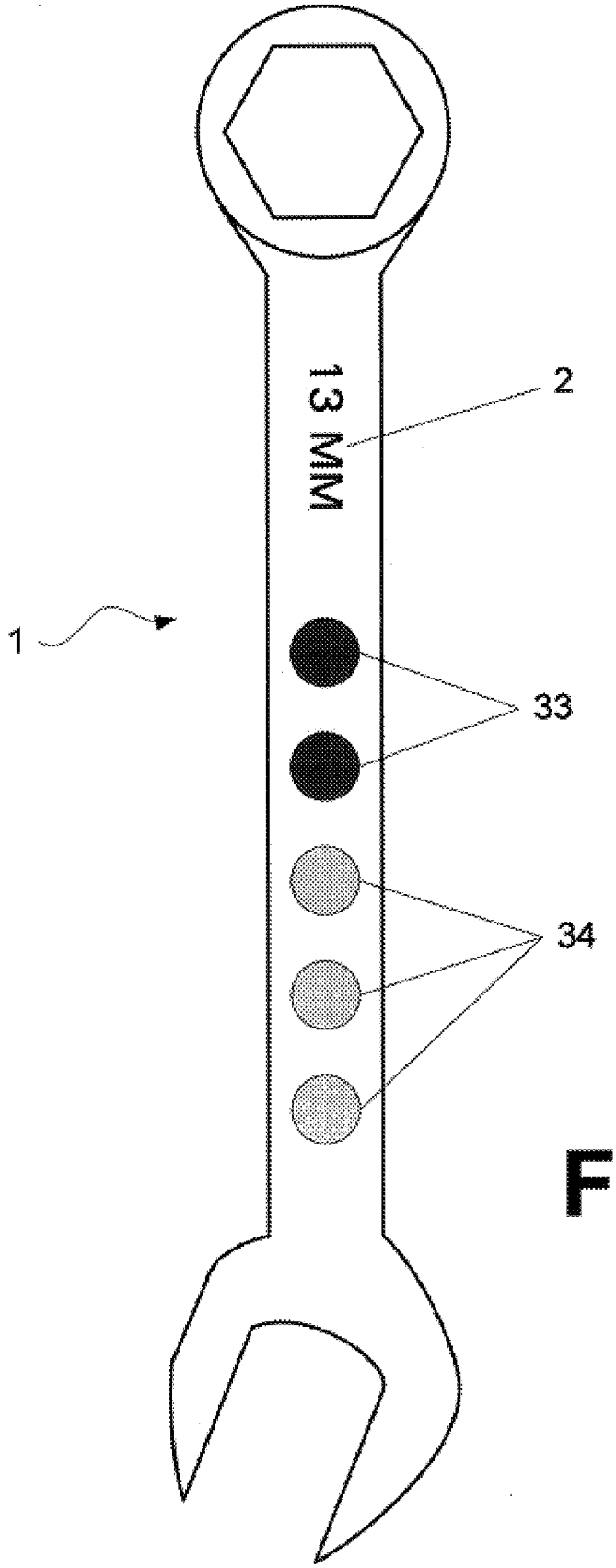
FIG. 3 illustrates a handled wrench the size of which is visually indicated by a third embodiment of the coding system of the present invention.

In another alternative embodiment, the bands could be replaced by any other meaningful configuration. For example, dots or spots 33 and 34, as shown in FIG. 3, could be used with a dash or bar taking the place of the dashed band on the smaller sized tools. Alternatively, dashes 23 and 24, as shown in FIG. 2, could be used, under the principles of the present invention, to mark the size of a tool 1. Again recesses for the dots, spots, dashes or bars, could be made in the tool to protect the markings against wear.

Another problem that arises is identifying the owner of a tool in a workplace where several people who each own their own tools are at work. In yet another embodiment, the present invention could be used to simultaneously identify tool ownership as well as size.

For example, if each person selects different sets of colors for the markings on their tools, ownership of the tools is readily determined. For example, person A may have a set of English tools marked with red and yellow markings and a set of metric tools marked with green and yellow markings. Person B may have a set of English tools marked with purple and orange markings and a set of metric tools marked with blue and orange markings. In this way, the ownership of a particular tool is easily determined.

As a further option on this embodiment, tools could be produced with the appropriate number of recesses indicating the size of each tool, but with no colored markings on the tool. A person could then purchase the tool set and, using the preformed recesses as a guide, mark the tools according to the present invention with colors which indicate that person's ownership as well as the tool size.

Alternatively, the tool could be provided with an extra pattern or sequence of recesses which could be painted by the user with a particular color or sequence or pattern of colors to indicate the ownership of the tool. A means of identifying the owner of a particular tool would be extremely welcome in an work place where several owners each have their own set of tools which may be of the same brand.

The preceding description has been presented only to illustrate and describe the invention. It is not intended to be exhaustive or to limit the invention to any precise form disclosed. Many modifications and variations are possible in light of the above teaching.

The preferred embodiment was chosen and described in order to best explain the principles of the invention and its practical application. The preceding description is intended to enable others skilled in the art to best utilize the invention in various embodiments and with various modifications as are suited to the particular use contemplated. It is intended that the scope of the invention be defined by the following claims.

What is claimed is:

1. A visually coded tool having a specified size, in relation to other tools in a tool set, which is denoted by visual coding, comprising:

a body of said tool; and at least one indicator disposed on said body of said tool;

wherein each of said indicators is of a particular type, wherein each type of indicator denotes a different discrete predetermined increment of size by which said tool is measured in relation to other tools in said tool set, such that a number of said indicators indicates said specified size of said tool.

2. A tool as claimed in claim 1, wherein said at least one indicator is two different types of indicators such that a sum of the increments denoted by said indicators indicates said specified size of said tool.

3. A tool as claimed in claim 1, wherein:

said at least one indicator is a plurality of indicators, at least one of which is of a first type and at least one of which is of a second type;

each indicator of said first type denotes a first predetermined increment of size by which said tool is measured, and each indicator of said second type denotes a second predetermined increment of size by which said tool is measured, said second predetermined increment being smaller than said first predetermined increment; and the sum of the first predetermined increments denoted by said indicators of the first type plus the sum of the second predetermined increments denoted by said indicators of the second type indicates said specified size of said tool.

4. A tool as claimed in claim 3, wherein said indicators of said first type are of a first color and said indicators of said second type are of a second color.

5. A tool as claimed in claim 3, wherein said first predetermined increment is five millimeters and said second predetermined increment is one millimeter.

6. A tool as claimed in claim 3, wherein said first predetermined increment is ¼ inch and said second predetermined increment is $\frac{1}{16}$ inch.

7. A tool as claimed in claim 1, wherein said at least one indicator is a colored band.

8. A tool as claimed in claim 1, wherein said at least one indicator is a colored dot.

9. A tool as claimed in claim 1, wherein said at least one indicator is recessed in said tool body.

10. A tool as claimed in claim 1, wherein said indicator is of a first type if said tool is measure in metric units and of a second type if said tool is measure in English units.

11. A tool as claimed in claim 1, wherein said at least one indicator is a colored dash.

12. A method of visually coding a tool having a specified size, in relation to other tools in a tool set, to indicate said specified size, the method comprising:

marking a body of said tool with at least one indicator, wherein each of said indicators denotes a discrete, predetermined increment of size by which said tool is measured in relation to other tools in said tool set; and counting said indicators to determine said specified size of said tool;

wherein said marking comprises marking said body of said tool with two different types of indicators, where each type of indicator denotes a discrete, predetermined increment of size by which said tool is measured in relation to other tools in said tool set such that a sum of the increments denoted by said indicators indicates said specified size of said tool.

13. A method as claimed in claim 12, wherein said marking comprises marking said body of said tool with a plurality of indicators, at least one of which is of a first type and at least one of which is of a second type;

wherein:

each indicator of said first type denotes a first predetermined increment of size by which said tool is measured, and each indicator of said second type denotes a second predetermined increment of size by which said tool is measured, said second predetermined increment being smaller than said first predetermined increment; and the sum of the first predetermined increments denoted by said indicators of the first type plus the sum of the second predetermined increment denoted by said indicators of the second type indicates said specified size of said tool.

14. A method as claimed in claim 13, wherein said marking with a plurality of indicators of first and second types further comprises marking said tool with at least one indicator of a first color and marking said tool with at least one indicator of a second color.

15. A method as claimed in claim 12, wherein said marking comprises marking with at least one indicator which is a colored band.

16. A method as claimed in claim 12, wherein said marking comprises marking with at least one indicator which is a colored dot.

17. A method as claimed in claim 12, wherein said marking further comprises recessing said at least one indicator in said tool body.

18. A method as claimed in claim 12, wherein said marking comprises marking with at least one indicator which is a colored dash.

* * * * *